United States Patent [19]

Dubois et al.

[11] Patent Number: 5,043,955

[45] Date of Patent: Aug. 27, 1991

[54] ANALOGIC DISPLAY MODULE FOR WATCH MOVEMENT

[75] Inventors: Gérald Dubois; Francois Berthoud, both of Le Lieu, Switzerland

[73] Assignee: Le Phare Jean d'Eve S.A., La Chaux-de-Fonds, Switzerland

[21] Appl. No.: 466,673

[22] Filed: Jan. 17, 1990

[30] Foreign Application Priority Data

Mar. 30, 1989 [CH] Switzerland ..... 1166/89

[51] Int. Cl.[5] ..... G04B 10/94; G04B 19/06

[52] U.S. Cl. ..... 368/228; 368/223

[58] Field of Search ..... 368/223-242

[56] References Cited

U.S. PATENT DOCUMENTS 2,361,563 10/1944 Pellaton ..... 368/80
3,699,761 10/1972 Onstott ..... 368/229
4,885,729 12/1989 Lee ..... 368/223

FOREIGN PATENT DOCUMENTS 0361587 10/1922 Fed. Rep. of Germany ..... 368/232
0165963 12/1933 Fed. Rep. of Germany ..... 368/228
1564818 3/1968 France ..... 368/232
65843 5/1950 Netherlands .
11900/71 6/1972 Switzerland .

*Primary Examiner*—Bernard Roskoski
*Attorney, Agent, or Firm*—Young & Thompson

[57] ABSTRACT

The invention relates to an analogic display module for watch movement which comprises several movement sector displays each comprising a movable display member (7-10) cooperating with at least one fixed mark (2-5). The time indications given by each sector display relate to each other sequentially fractions of days or hours following after without discontinuity.

14 Claims, 4 Drawing Sheets

ANALOGIC DISPLAY MODULE FOR WATCH MOVEMENT

The present invention relates to an analogic display module comprising a dial, hands and a driving mechanism of its hands through a drive member of a horological movement, constitued generally by the cannon-pinion completing one revolution in one hour. This display module is intended to be fixed on the watch movement in place of the conventional dial and hands and its aim is the realization of a new type of time display enabling a new disposition of the dial and of the hands creating a wholly new esthetical appearance of the watch.

This analogic display module distinguishes itself by the fact that it comprises for the indication of the hours or of the minutes several sector displays each comprising a movable display member cooperating with at least one fixed index, and in which further the time indication given by, each sector display concerns fractions of days or of hours which follow each other sequentially without discontinuity.

The attached drawings show schematically and by way of example three embodiments of the display module according to the present invention.

DETAILED DESCRIPTION OF PREFERRED EMBODIMENTS

Figure 1:
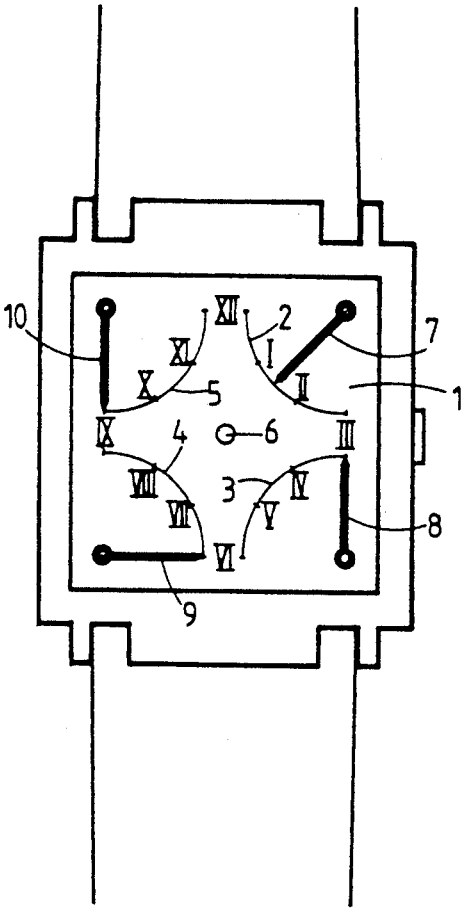
FIG. 1 is a top view of the dial and the hands of a first embodiment of the display module.

The first embodiment of the display module, shown in FIG. 1 comprises a dial 1 comprising a graduation representing the hours formed of four circular sectors 2,3,4,5 symetrically disposed with respect to the center 6 of the dial 1 and each representing a time interval of three hours. Each of these time sectors 2,3,4,5 cooperates with a hand 7,8,9,10 respectively which are pivoted near the four corners of the dial 1.

The time sector 2 and the hand 7 enable display the time between noon and three o'clock; the sector 3 and the hand 8 display the time between three and six o'clock; the sector 4 and the hand 9 display the time between six and nine o'clock and the sector 5 and the hand 10 display the time between nine hours and noon or midnight.

Each of these time sectors and the associated hand forms a time display for a time interval of at least three hours.

Figure 2:
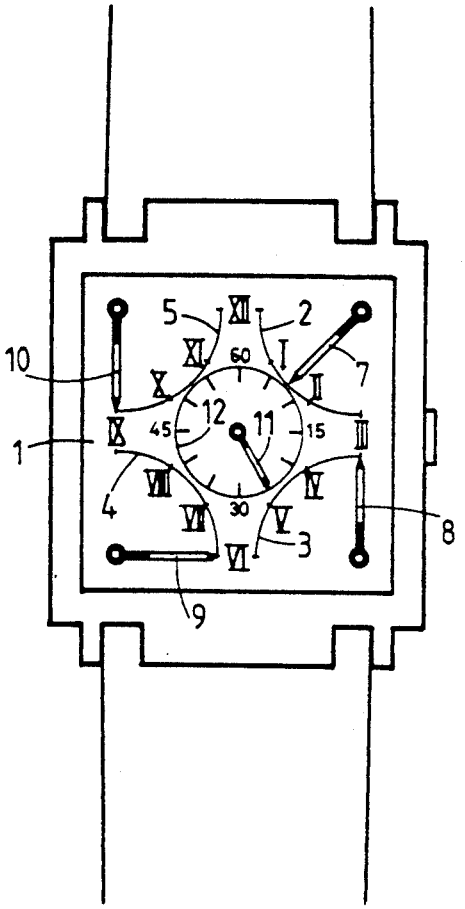
FIG. 2 is a top view of the dial and the hands of a second embodiment of the display module.
Figure 3:
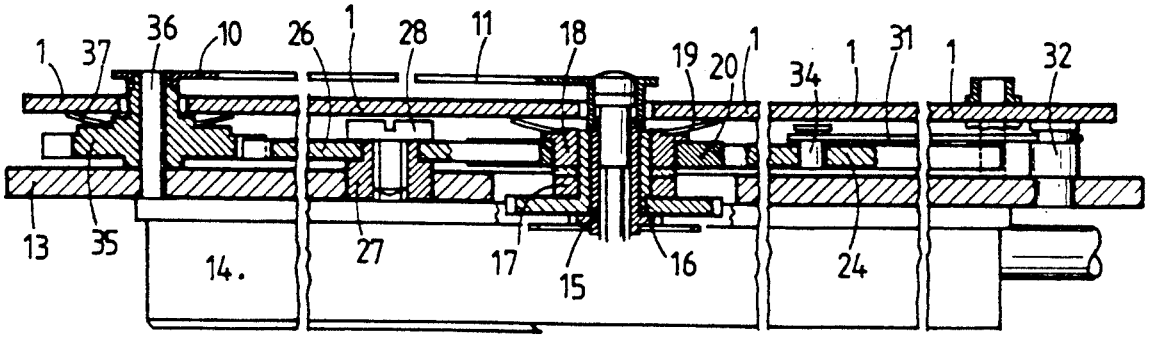
FIG. 3 is a partial cross section along line III—III of FIG. 4 showing the driving mechanism of the hands of the second embodiment of the display module.
Figure 4:
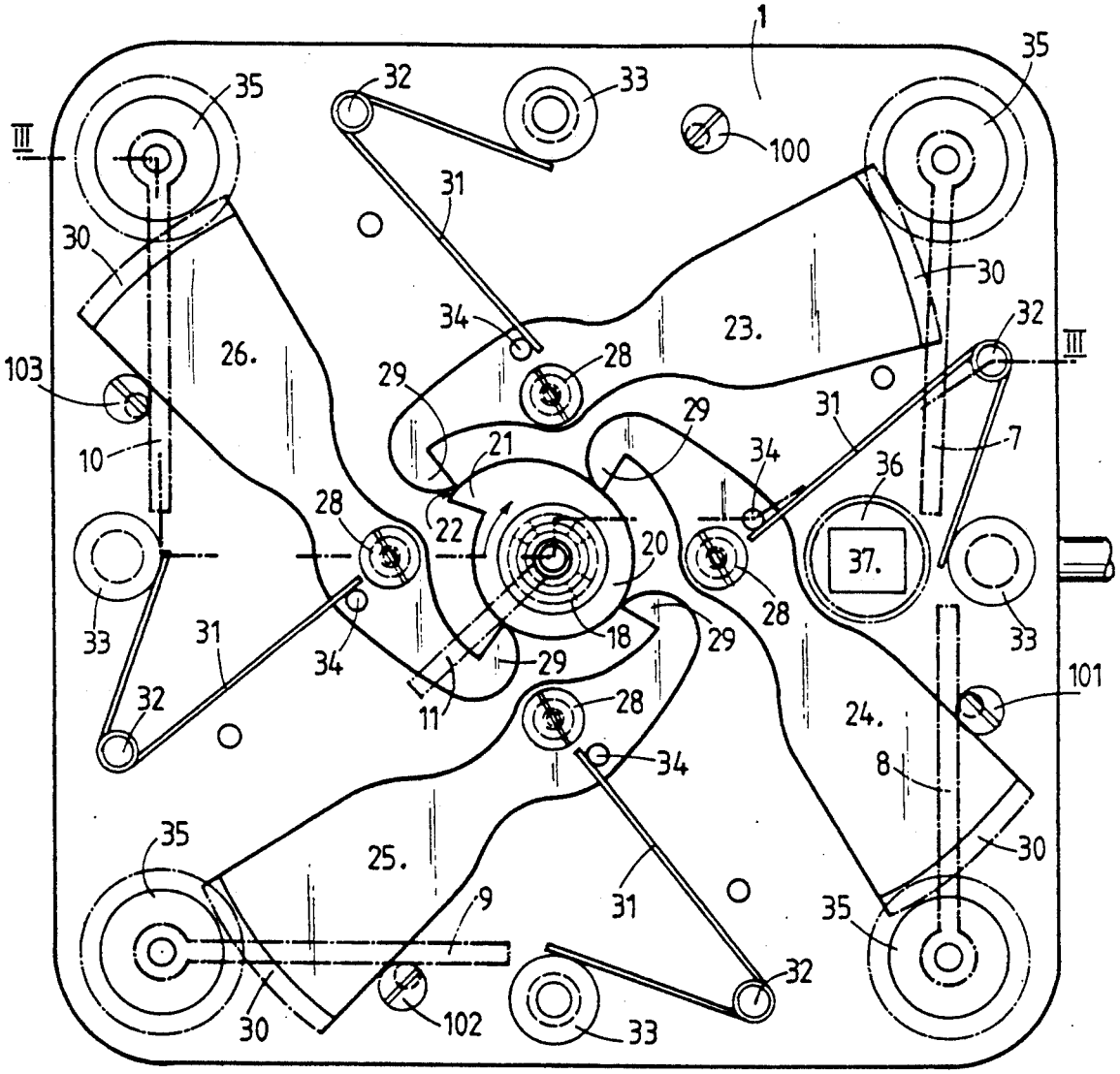
FIG. 4 is a view from below of the mechanism of the second embodiment of the display device.

The mechanism for driving these retrograde movement sector hands 7,8,9, and 10 is substantially identical to that of the second embodiment of the display module shown at FIGS. 2,3 and 4 and will therefore be described in the context of said second embodiment.

The time display of said second embodiment of the module is identical to that of the first embodiment but for a fifth hand 11 pivoted at the center which cooperates with a concentric graduation 12 to indicate the minutes.

The mechanism of the display module driving the hands 7,8 9,10 and 11 will now be described with reference to FIGS. 3 and 4.

The display module comprises a base plate 13 fixed by any known means on the horological movement 14 the cannon-pinion 15 of which is used as driving member, making one revolution in one hour, for driving the mechanism of the display module. This cannon-pinion 15 carries at its upper end the minutes hand 11.

The cannon-pinion 15 is connected by the usual gear-train of the works (not shown) of the movement 14 to the hours wheel 16, fastened with a cannon, idly pivoted around the cannon-pinion 15.

A disc 17 is fixed to the cannon of the hour wheel 16 and its upper surface constitutes a Bréguet-type coupling, i.e. ratchet-wheel, with a hub 18 idly pivoted on said cannon and applied against the disc 17 by means of a cup-spring 19 resting against the dial 1.

In this way the hub 18 is driven by friction or at least by means of a coupling system enabling a relative angular movement between the disc 17 fastened with the hours wheel and this hub 18 in case of an excessive torque, particularly during time setting in the opposed direction to the time indications.

The hub 18 is fastened with a snail cam 20 having a circular peripheral portion, concentric to the hub 18 about approximatively three quarters of its periphery and a lift 21 extending about somewhat more than one quarter of its periphery, the last portion 22 of said lift 21 being concentric to the hub 18. This cam 20,21,22 makes one revolution in twelve hours and its periphery cooperates with four levers 23,24,25,26 each pivoted on a trunnion 27 driven in the base plate 13 of the module and maintained by means of screws 28.

Each of these levers 23–26 has a beak 29 at one of its ends and a toothed sector 30 at its other end. Wire springs 31 fixed to a pin 32 driven in the base plate 13 rest on a fixed abutment 33 and on a lug 34 of each lever and tend thus to maintain the beak 29 of each these levers 23–26 against the periphery of the cam 20.

Each hand 7,8,9,10 is carried by a wheel 35 pivoted on an axle 36 driven in the base plate 13 with which it rests in contact due to the effect of a spring 37 bearing under the dial 1. The toothing of each of these wheels 35 is in mesh with the toothed sector 30 of the corresponding lever 23–26.

The position of the mechanism shown in FIG. 4 corresponds to the display of three o'clock. The beak 29 of the lever 23 driving the hand 7 is at the maximum of the lift 21, it reachs the concentric portion 22 of said lift so that the hand 7 indicates three o'clock. At this moment, the lever 24 actuating the hand 8 begins to be actuated by the lift 21. During two to fifteen minutes, corresponding to the concentric portion 22 of the lift 21, the hand 7 remains on three o'clock whereas the hand 8 moves towards four o'clock. Then the beak 29 of the lever 23 leaves the lift 21 and the hand 7 comes instantaneously back to its initial position indicating twelve hours.

The user can thus read the time indication successively on the four parts of the time display 2,7;3,8;4,9 and 5,10 without discontinuity, the hand of the preceeding sector remaining at the end of its stroke during the time necessary for the hand of the next display sector to be sufficiently advanced to avoid any ambiguity as to which sector has to be looked at for the indication of the time at each moment. The minutes are displayed by the central display 11,12.

In the first embodiment, FIG. 1, which has no minutes indication, the mechanism is identical to the one just described but for the fact that the cannon-pinion 15 does not carry a hand.

The base plate 13 of the display module comprises an opening 36 and the dial 1 comprises an aperture 37 enabling the user to see a date indication of the movement 14 through the display module.

Figure 5:
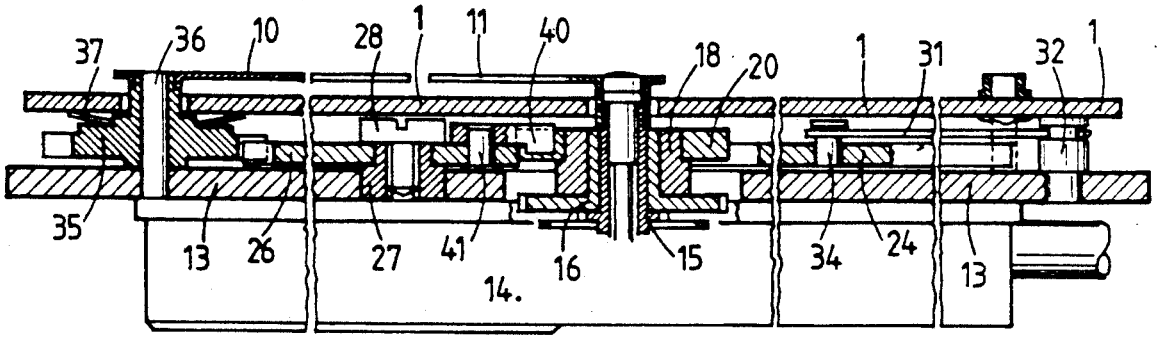
FIGS. 5 and 6 are views similar to FIGS. 3 and 4 showing a variant of the mechanism of the second embodiment of the display module.
Figure 6:
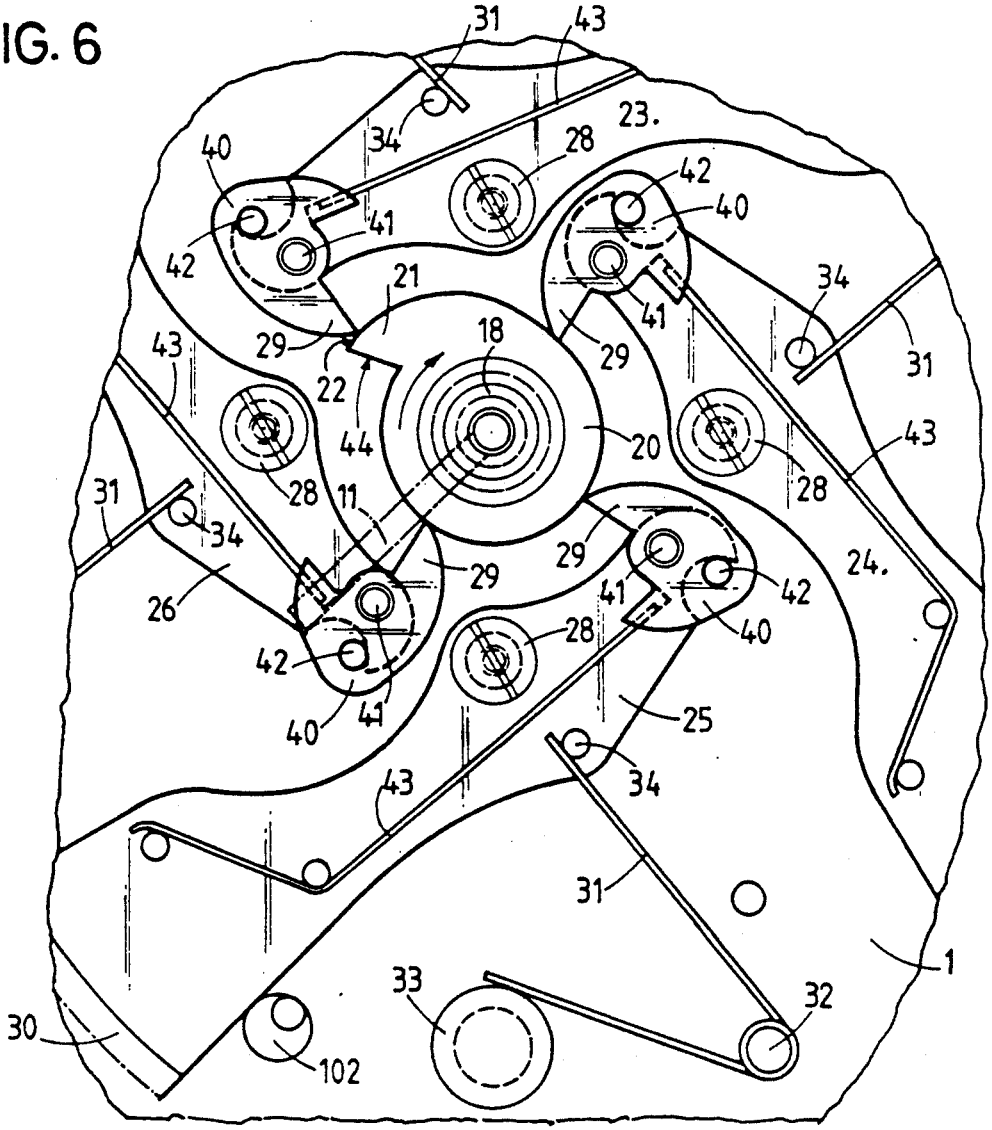
Figure 7:
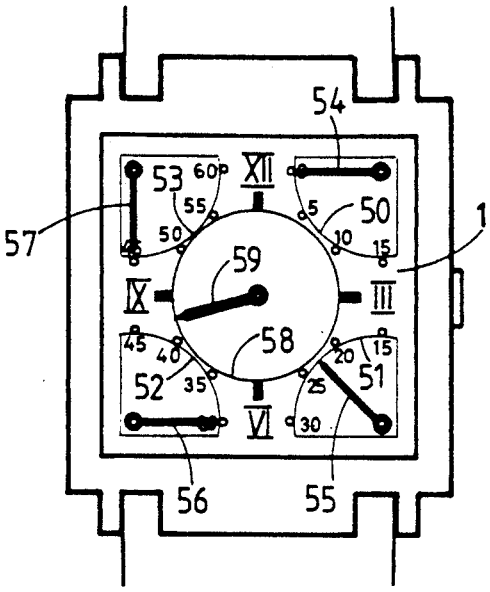
FIG. 7 shows the dial and the hands of a third embodiment of the display module.
Figure 8:
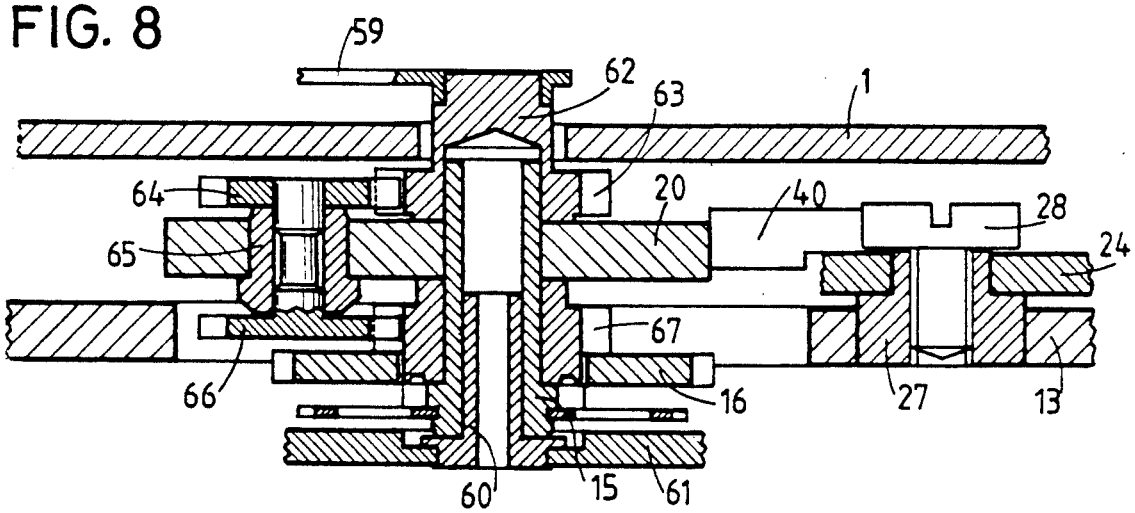
FIG. 8 is a partial cross section along line VIII—VIII of FIG. 9 of the mechanism driving the hands of the third embodiment of the display module.
Figure 9:
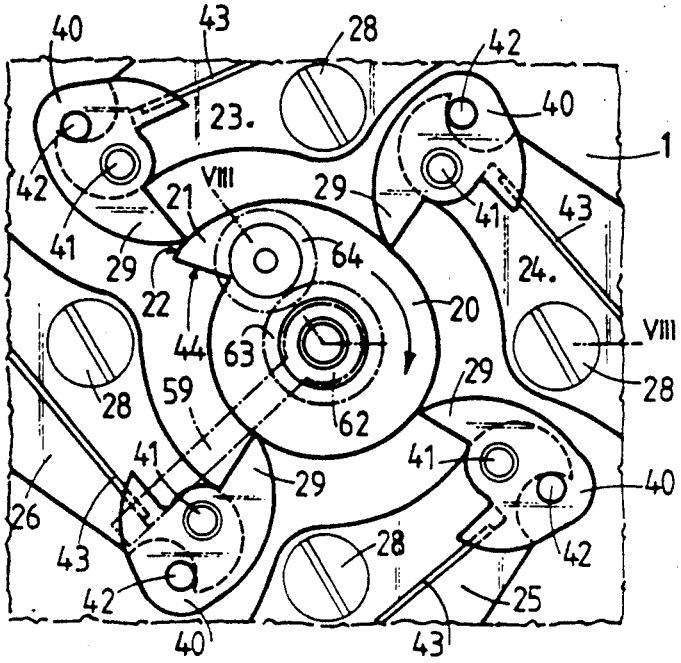
FIG. 9 is a partial view from underneath of the third embodiment of the display module.

FIGS. 5 and 6 show a variant of the mechanism of this second embodiment of the display module in which the hub 18 is directly fastened with the cannon-pinion 15.

The principle of the mechanism and of the greater portion of its realization are the same as those described herebefore. Simply due to the fact that the cam 20 is solid with the cannon-pinion 15, the beaks 29 of each lever 23–26 are carried by parts 40 hinged on the end of the levers in 41. These parts 40 carry a pin 42 and are subjected to the action of a spring 43 tending to maintain them in service position, the pin 42 resting against the corresponding levers 23–26.

So during the time setting, particularly in the counter clockwise direction to the normal time display, when the beaks 29 abut against the face 44 of the lift 21 of the cam 20 the parts 40 are displaced against the action of this spring 43 and come back into service position. Any deterioration of the mechanism is therefore avoided.

In the third embodiment of the display module the dial 1 comprises four sector type displays located in the four corners of the dial comprising each a minutes graduation 50,51,52,53 and a corresponding minutes hand 54,55,56,57. The dial is provided with a central concentric display of the hours comprising a graduation 58 and hours hand 59. Each retrograde sector display corresponds to one quarter of a hour and the indications follow each other sequentially to display the sixty minutes of an hour.

The mechanism of this embodiment of the display module is of the type of the one described in reference to FIGS. 5 and 6 but that the cam 20 is fastened with the cannon-pinion 15 which is idly pivoted on a cannon 60 fastened with the upper bridge 61 of the time piece movement. Therefore the hands 54 to 57 indicate the minutes since the cam makes a complete revolution in one hour.

The central hours hand 59 is carried by a wheel 62 idly pivoted on the upper end of the cannon-pinion 15. The toothing 63 of this wheel 62 meshes with the toothing of a pinion 64 pivoted in a cannon 65 driven into a bore of the cam 20. A second pinion 66 is also pivoted in said cannon 65, located on the other side of the cam 20, and meshes with a pinion 67 fastened with the hours wheel 16. The gear-ratio introduced by this Rinematic chain is 1:1 so that the hand 59 revolves at the same speed as the hours wheel 16 which is driven by a wheel of the gearing from the minutes wheel of the watch movement, revolving at one turn for twelve hours.

Thanks to this display module, driven by any conventional time piece movement, which can be mechanical, automatic or of the quartz type, one obtains a time display mode which is completely new, permitting a revolutionnary appearance and design of the dial of the watch.

It is evident that numerous variants and embodiments can be envisaged for such a display module which consist in principle is having several displays of the sector type comprising each a movable display member cooperating with at least one fixed index, the time indications delivered by each sector display relating to portions of days, or of hours, which follow each other sequentially without discontinuity.

It is possible to have only two or three sector displays corresponding to six or four hours each or to thirty or twenty minutes. It is also possible to have more than four sector displays, their number depending principally on the esthetic and on the shape of the watch case.

Instead of hands moving in front of graduations one can have a fixed index on the dial cooperating with a movable graduation and this without modification of its principle of the module mechanism.

In the three embodiments and to avoid that the four beaks 29 of the levers 23,24,25 and 26 rest simultaneously against the periphery of the cam 20 introducing thus a braking action, four excentric abutments 100,101,102 and 103, fixed in the plate 13, act as four abutments when the respective levers are in fall down position under the effect of their respective spring 31. These abutments having excentric pivots, it is possible to turn them individually and set each lever so as to leave a small gap between the beaks 29 of the levers and the lower position of the cam 20, in order to reduce the friction of the beaks on the cam, by cancelling the friction of three or of at least two of the beaks out of four.

The three embodiments have been represented for square shaped watches. It is evident that this device can be integrated in watches cases of any shape, even with circular cases and dials.

We claim:

1. Analogic display module for time piece movement, comprising a plurality of sector displays on a common substrate, each said display comprising a fixed index on which is displayed a time sector comprised by a plurality of sequential indicia of units of time and a movable display member driven by said movement to indicate time on each said index, the time indicia on each index being followed sequentially by the time indicia on another index, only one said movable display member indicating the correct time at any given instant and said movable display members being operable to indicate the correct time sequentially as the correct time falls within the corresponding time sector.

2. Module as claimed in claim 1, there being four said indices each indicating a time sector of three hours.

3. Module as claimed in claim 1, there being four said indices each indicating a time sector of 15 minutes.

4. Module as claimed in claim 1, there being four said indices surrounding a circular central display of time units.

5. Module as claimed in claim 1, said movable display members being driven by a wheel meshing with a toothed sector of a lever pivoted on a base plate of the module, one end of said lever comprising a beak cooperating with a cam driven in rotation by said movement.

6. Module as claimed in claim 5, in which the cam has a low portion concentric to an axis of rotation of said movement and a lift of progressive amplitude extending about an angular distance corresponding to the time interval to be displayed by each sector display.

7. Module as claimed in claim 6, in which the lift of the cam comprises an end of a higher portion of the cam which is concentric with said axis and the angular extend of which corresponds to a fraction of the time sector displayed by each index.

8. Module as claimed in claim 5, which comprises a Bréguet-type coupling between said cam and a driving member of said movement.

9. Module as claimed in claim 5, in which said beak of each lever is carried by a part hinged on an end of the associated said lever, part of said lever being maintained in a service position by a spring and an abutment.

10. Module as claimed in claim 5, in which the cam is driven by a cannon-pinion of said movement.

11. Module as claimed in claim 5, in which the cam is driven by an hours wheel of said movement.

12. Module as claimed in claim 10, in which the cannon-pinion carries a hand of a central concentric time display.

13. Module as claimed in claim 11, in which a hand of a central concentric display is driven by an hours wheel of the movement through an intermediate wheel idly pivoted on said cam.

14. Module as claimed in claim 1, which comprises a portion of a time piece.

* * * * *